US008976090B2

(12) United States Patent
Yamamoto et al.

(10) Patent No.: US 8,976,090 B2
(45) Date of Patent: Mar. 10, 2015

(54) PIXEL CIRCUIT WITH MULTIPLE HOLDING CAPACITORS, METHOD OF DRIVING THE PIXEL CIRCUIT, DISPLAY PANEL, DISPLAY DEVICE AND ELECTRONIC UNIT

(75) Inventors: Tetsuro Yamamoto, Kanagawa (JP); Katsuhide Uchino, Kanagawa (JP)

(73) Assignee: Sony Corporation, Tokyo (JP)

( * ) Notice: Subject to any disclaimer, the term of this patent is extended or adjusted under 35 U.S.C. 154(b) by 310 days.

(21) Appl. No.: 13/406,066

(22) Filed: Feb. 27, 2012

(65) Prior Publication Data

US 2012/0223978 A1 Sep. 6, 2012

(30) Foreign Application Priority Data

Mar. 4, 2011 (JP) ..... 2011-048377

(51) Int. Cl.
*G09G 3/30* (2006.01)
*G09F 9/33* (2006.01)
*G09G 3/32* (2006.01)

(52) U.S. Cl.
CPC ... *G09F 9/33* (2013.01); *G09G 3/32* (2013.01)
USPC ..... 345/78; 345/76; 345/212

(58) Field of Classification Search
CPC ..... G09G 3/32; G09F 9/33
USPC ..... 345/76, 78, 212
See application file for complete search history.

(56) References Cited

U.S. PATENT DOCUMENTS

| | | | | |
|---|---|---|---|---|
| 8,253,659 | B2 * | 8/2012 | Maekawa et al. | 345/76 |
| 8,305,303 | B2 * | 11/2012 | Nam | 345/76 |
| 2006/0022907 | A1 * | 2/2006 | Uchino et al. | 345/76 |
| 2009/0256827 | A1 * | 10/2009 | Tanikame | 345/204 |

FOREIGN PATENT DOCUMENTS

JP 2009-300697 12/2009

* cited by examiner

*Primary Examiner* — Kwang-Su Yang
(74) *Attorney, Agent, or Firm* — Rader, Fishman & Grauer PLLC

(57) ABSTRACT

There is provided a pixel circuit capable of obtaining high-luminance while suppressing power consumption. Further, there are provided a display panel having the pixel circuit, and a display device including the display panel. Still further, there is provided an electronic unit including the display device. The pixel circuit includes a first transistor driving a light-emitting element, a plurality of holding capacitors connected in series between a gate and a source of the first transistor, a second transistor provided between a first signal line and the gate of the first transistor, and a third transistor provided between a second signal line and one of junctions of the holding capacitors.

15 Claims, 13 Drawing Sheets

RELATED ART

RELATED ART

PIXEL CIRCUIT WITH MULTIPLE HOLDING CAPACITORS, METHOD OF DRIVING THE PIXEL CIRCUIT, DISPLAY PANEL, DISPLAY DEVICE AND ELECTRONIC UNIT

BACKGROUND

The present disclosure relates to a pixel circuit included in a pixel of a display panel. The present disclosure also relates to a display panel in which a plurality of pixels each including the above-described pixel circuit are two-dimensionally disposed and a display device which has the display panel. Further, the present disclosure relates to an electronic unit including the above-described display device.

In recent years, in the field of display devices for displaying images, display devices are developed and commercialized which use, as a light-emitting element of a pixel, an optical element of a current driven type, such as an organic EL (electro luminescence) element, whose light-emission luminance is varied according to a current value flowing therein. Unlike a liquid crystal element and the like, the organic EL element is a self-luminous element. Therefore, since a light source (backlight) is not necessary, a display device (organic EL display device) using the organic EL element provides higher image visibility, decreased power consumption, and higher response speed of element in comparison with a liquid crystal display device which necessitates a light source.

Similarly to liquid crystal display devices, the driving method for organic EL display devices includes a simple (passive) matrix method and an active matrix method. The former has a risk that it is difficult to realize a large-size and high-definition display device, although the structure thereof is simple. Therefore, currently, the active matrix method is actively developed. In this method, a current flowing through a light-emitting element in each pixel is controlled by an active element (in general, TFT (Thin Film Transistor)) provided in a drive circuit provided for each light-emitting element. The pixel circuit includes a plurality of active elements (in general, TFT (Thin Film Transistor)), a capacitative element and the like (see, Japanese Unexamined Patent Application Publication No 2009-300697).

FIG. 16 illustrates a schematic configuration of each pixel of the display device described in Japanese Unexamined Patent Application Publication No 2009-300697. The pixel described in FIG. 16 is made up of an organic EL element D100 and a pixel circuit 100 connected to the organic EL element D100. The pixel circuit 100 has a circuit configuration of 2Tr1C and is made up of a transistor T100 used for a sampling, a holding capacitor C100, and a transistor T200 used for a drive. A write line WSL is formed to extend in a row direction, and connected to a gate of the transistor T100. A power source line PSL is also formed to extend in a row direction, and connected to a drain of the transistor T200. The signal line DTL is formed to extend in a column direction, and connected to a drain of the transistor T100. A source of the transistor T100 is connected to a gate of the transistor T200 used for a drive and one end of the holding capacitor C100. A source of the transistor T200 and the other end of the holding capacitor C100 are connected to an anode of the organic EL element D100. A cathode of the organic EL element D100 is connected to a ground line GND.

Next, operations (operations from turning off to turning on of light) of a pixel described in FIG. 17 are explained. (A) to (C) of FIG. 17 illustrate exemplary waveforms of voltages applied to the pixel described in FIG. 16. Specifically, (A) to (C) of FIG. 17 show a state where two kinds of voltages (Vss and Vcc) are applied to the power source line PSL, a state where two kinds of voltages (Vsig and Vofs) are applied to the signal line DTL, and a state where two kinds of voltages (Von and Voff) are applied to the write line WSL, respectively. (D) to (F) of FIG. 17 show temporal changes of a gate voltage Vg and a source voltage Vs of the transistor T200 in response to voltages applied to the power source line PSL, the signal line DTL, and the write line WSL.

Threshold Correction Preparation Period

Firstly, preparations for threshold correction are made. Specifically, a drive circuit (not shown) decreases the voltage of the power source line PSL from Vcc to Vss (t1). Then, the source voltage Vs becomes Vss, and the light emission of the organic EL element D100 is stopped. Next, the drive circuit switches the voltage of the signal line DTL from Vsig to Vofs (t2), and thereafter, while the voltage of the power source line PSL is Vss, the drive circuit raises the voltage of the write line WSL from Voff to Von (t3). Then, the gate voltage Vg drops to Vofs.

First Threshold Correction Period

Next, a threshold correction is carried out. Specifically, while the voltage of the signal line DTL is Vofs, the drive circuit raises the voltage of the power source line PSL from Vss to Vcc (t4). Then, a current Ids flows between the drain and the source of the transistor T200 to raise the source voltage Vs. Thereafter, before switching the voltage of the signal line DTL from Vofs to Vsig, the drive circuit decreases the voltage of the write line WSL from Von to Voff (t5). Then, the gate of the transistor T200 is set to a floating state, and the threshold correction is temporarily stopped.

Correction Suspension Period

During a period in which the threshold correction is suspended, a sampling of the voltage of the signal line DTL is carried out at another row (pixel) different from the row (pixel) which has undergone the threshold correction. When the threshold correction is inadequate, that is, when the potential difference Vgs between the gate and the source of the transistor T200 is higher than the threshold voltage of the transistor T200, even during the threshold correction suspension period, a current Ids flows between the drain and the source of the transistor T200 at the row (pixel) which has undergone the threshold correction to raise the source voltage Vs, and the gate voltage Vg is also raised due to a coupling through the holding capacitor C100. Thereafter, during the correction suspension period, the drive circuit switches the voltage of the signal line DTL from Vofs to Vsig (t6).

Writing•Mobility Correction Period

After the threshold correction suspension period is finished, a writing and mobility correction are carried out. Specifically, while the voltage of the signal line DTL is Vsig, the drive circuit raises the voltage of the write line WSL from Voff to Von (t7), and connects the gate of the transistor T200 to the signal line DTL. Then, the gate voltage of the transistor T200 becomes Vsig. At this time, the anode voltage of the organic EL element D100 at this stage is still lower than the threshold voltage of the organic EL element D100, and the organic EL element D100 is in a cut-off state. Therefore, since the current Ids flows through a element capacitance (not shown) of the organic EL element D100 and the element capacitance is charged, the source voltage Vs is raised by ΔV, and the potential difference Vgs becomes Vsig+Vth−ΔV in the course of time. In this way, the writing and the mobility correction are carried out at the same time. Here, the higher the mobility of the transistor T200, the larger ΔV is obtained, so that variation in mobility among pixels may be reduced by decreasing the potential difference Vgs by ΔV prior to an emission of light.

Emission of Light

Finally, the drive circuit decreases the voltage of the write line WSL from Von to Voff (t8). Then, the gate of the transistor T200 is set to a floating state, and the current Ids flows between the drain and the source of the transistor T200 to raise the source voltage Vs. As a result, the organic EL element D100 emits light with a desired luminance.

SUMMARY

Incidentally, in the pixel described in FIG. 16, the higher the voltage applied to the signal line DTL, the higher the intensity of light emitted by the organic EL element D100. In order to obtain high-luminance in the pixel described in FIG. 16, high voltage needs to be applied to the signal line DTL. However, there is an issue that, if an output of a driver driving the signal line DTL is increased to apply a high voltage to the signal line DTL, then current amount for discharging or charging the signal line DTL is also increased, resulting in higher power consumption. In addition, there is also a case where expensive components need to be used as a driver to increase an output of the driver. In that case, there is a risk that the component cost is increased. Therefore, in terms of low power consumption and low cost, the output of the driver is desirably decreased. Although, if the output of the driver is excessively decreased, the current amount flowing through the organic EL element D100 is also decreased, and desired luminance may not be obtained.

It is desirable to provide a pixel circuit capable of obtaining high-luminance while suppressing power consumption. Further, it is desirable to provide a display panel having the pixel circuit, and a display device including the display panel. Still further, it is desirable to provide an electronic unit including the display device.

A first pixel circuit of an embodiment of the present disclosure includes a first transistor driving a light-emitting element and a plurality of holding capacitors connected in series between a gate and a source of the first transistor. The pixel circuit further includes a second transistor provided between a first signal line and the gate of the first transistor, and a third transistor provided between a second signal line and one of junctions of the holding capacitors.

A first display panel of an embodiment of the present disclosure includes a plurality of pixels each including a light-emitting element, and a pixel circuit driving the light-emitting element. The pixel circuit has a first transistor driving the light-emitting element, one or more first holding capacitors connected between a gate and a source of the first transistor, a second transistor provided between a first signal line and the gate of the first transistor, a third transistor provided between a second signal line and the gate of the first transistor, and one or more second holding capacitors provided between a source of the third transistor and the gate of the first transistor.

A first display device of an embodiment of the present disclosure includes a display panel and a drive circuit that drives the display panel having a plurality of pixels, each of the pixels including a light-emitting element and a pixel circuit that drives the light-emitting element. The pixel circuit includes a first transistor driving a light-emitting element, a plurality of holding capacitors connected in series between a gate and a source of the first transistor, a second transistor provided between a first signal line and the gate of the first transistor, and a third transistor provided between a second signal line and one of junctions of the holding capacitors.

A first electronic unit of an embodiment of the present disclosure has a display device, the display device including a display panel and a drive circuit that drives the display panel having a plurality of pixels, each of the pixels including a light-emitting element and a pixel circuit that drives the light-emitting element. The pixel circuit includes a first transistor driving the light-emitting element, a plurality of holding capacitors connected in series between a gate and a source of the first transistor, a second transistor provided between a first signal line and the gate of the first transistor, and a third transistor provided between a second signal line and one of junctions of the holding capacitors.

With the first pixel circuit, the first display panel, the first display device, and the electronic unit of the embodiments of the present disclosure, the voltage of the first signal line is sampled by the second transistor, and written in the gate of the first transistor. Further, the voltage of the second signal line is sampled by the third transistor, and written in one of junctions of the holding capacitors. Thus, it is possible to raise the gate voltage of the first transistor up to a voltage higher than the voltage of the first signal line to turn on the first transistor.

A second pixel circuit of an embodiment of the present disclosure includes a first transistor driving a light-emitting element and one or more first holding capacitors connected between a gate and a source of the first transistor. The pixel circuit further includes a second transistor provided between a first signal line and the gate of the first transistor, a third transistor provided between a second signal line and the gate of the first transistor, and one or more second holding capacitors provided between a source of the third transistor and the gate of the first transistor.

A second display panel of an embodiment of the present disclosure includes a plurality of pixels each including a light-emitting element and a pixel circuit that drives the light-emitting element. The pixel circuit has a first transistor driving the light-emitting element, one or more first holding capacitors connected between a gate and a source of the first transistor, a second transistor provided between a first signal line and the gate of the first transistor, a third transistor provided between a second signal line and the gate of the first transistor, and one or more second holding capacitors provided between a source of the third transistor and the gate of the first transistor.

A second display device of an embodiment of the present disclosure includes a display panel and a drive circuit that drives the display panel having a plurality of pixels, each of the pixels including a light-emitting element and a pixel circuit that drives the light-emitting element. The pixel circuit includes a first transistor driving a light-emitting element, one or more first holding capacitors connected between a gate and a source of the first transistor, a second transistor provided between a first signal line and the gate of the first transistor, a third transistor provided between a second signal line and the gate of the first transistor, and one or more second holding capacitors provided between a source of the third transistor and the gate of the first transistor.

A second electronic unit of an embodiment of the present disclosure includes a display device, the display device including a display panel and a drive circuit that drives the display panel having a plurality of pixels, each of the pixels including a light-emitting element and a pixel circuit that drives the light-emitting element. The pixel circuit includes a first transistor driving the light-emitting element, one or more first holding capacitors connected between a gate and a source of the first transistor, a second transistor provided between a first signal line and the gate of the first transistor, a third transistor provided between a second signal line and the gate of the first transistor, and one or more second holding capacitors provided between a source of the third transistor and the gate of the first transistor.

With the second pixel circuit, the second display panel, the second display device, and the second electronic unit of the embodiment of the present disclosure, the voltage of the first signal line is sampled by the second transistor and written in the gate of the first transistor. Further, the voltage of the second signal line is sampled by the third transistor and written in the second holding capacitor. Thus, it is possible to raise a gate voltage of the first transistor up to a voltage higher than the voltage of the first signal line to turn on the first transistor.

According to an embodiment of the present disclosure, there is provided a method of driving a pixel circuit. The pixel circuit has a sampling circuit sampling voltages of a first signal line and a second signal line, a holding circuit holding the voltages sampled by the sampling circuit, and a drive circuit driving a light-emitting element based on the voltages held by the holding circuit. The method includes: allowing the sampling circuit to perform a first sampling of the voltages of the first signal line and the second signal line, while a gray-scale voltage is applied to the first signal line and a basic voltage is applied to the second signal line; and allowing the sampling circuit to perform a second sampling of only the voltage of the second signal line, while the voltage obtained by the first sampling is held in the holding circuit and while the gray-scale voltage is applied to the second signal line.

With the driving method of the embodiment of the present disclosure, after the voltages of the first signal line and second signal line are sampled, when the voltage obtained by the sampling is held in the holding circuit and a voltage commensurate with a gray-scale is applied to the second signal line, only the voltage of the second signal line is sampled by the sampling circuit. Thus, a voltage higher than the voltage of the first signal line may be held in the holding circuit, and the light-emitting element may be driven based on such a higher voltage.

According to the first and second pixel circuits, the first and second display panels, the first and second display devices, and the first and second electronic units of the embodiments of the present disclosure, since the gate voltage of the first transistor may be raised up to a voltage higher than the voltage of the first signal line to turn on the first transistor, the light-emission luminance of the light-emitting element may be increased without applying a high voltage to the signal line. In other words, an effect similar to increasing the output of a signal driver which applies a voltage to the signal line may be obtained. Consequently, the high-luminance may be obtained while suppressing the power consumption of the signal driver.

According to the driving method of the embodiment of the present disclosure, since it is possible to hold in the holding circuit a voltage higher than the voltage of the first signal line to drive the light-emitting element based on such a higher voltage, the light-emission luminance of the light-emitting element may be increased without applying a high voltage to a signal line. In other words, an effect similar to increasing the output of a signal driver which applies a voltage to the signal line may be obtained. Consequently, the high-luminance may be obtained while suppressing the power consumption of the signal driver.

It is to be understood that both the foregoing general description and the following detailed description are exemplary, and are intended to provide further explanation of the technology as claimed.

BRIEF DESCRIPTION OF THE DRAWINGS

The accompanying drawings are included to provide a further understanding of the disclosure, and are incorporated in and constitute a part of this specification. The drawings illustrate embodiments and, together with the specification, serve to explain the principles of the technology.

FIG. 15A is a front elevational view in an opened state; FIG. 15B is a side view in an opened state; FIG. 15C is a front elevational view in a closed state; FIG. 15D is a left side view; FIG. 15E is a right side view; FIG. 15F is a top view; and FIG. 15G is a bottom view.

DETAILED DESCRIPTION

Embodiments of the present disclosure will be specifically described below with reference to the drawings. The description will be made in the following order.

1. Embodiment (Display Device)
2. Modification (Display Device)
3. Application Example (Electronic Unit)

1. Embodiment

Configuration

Figure 1:
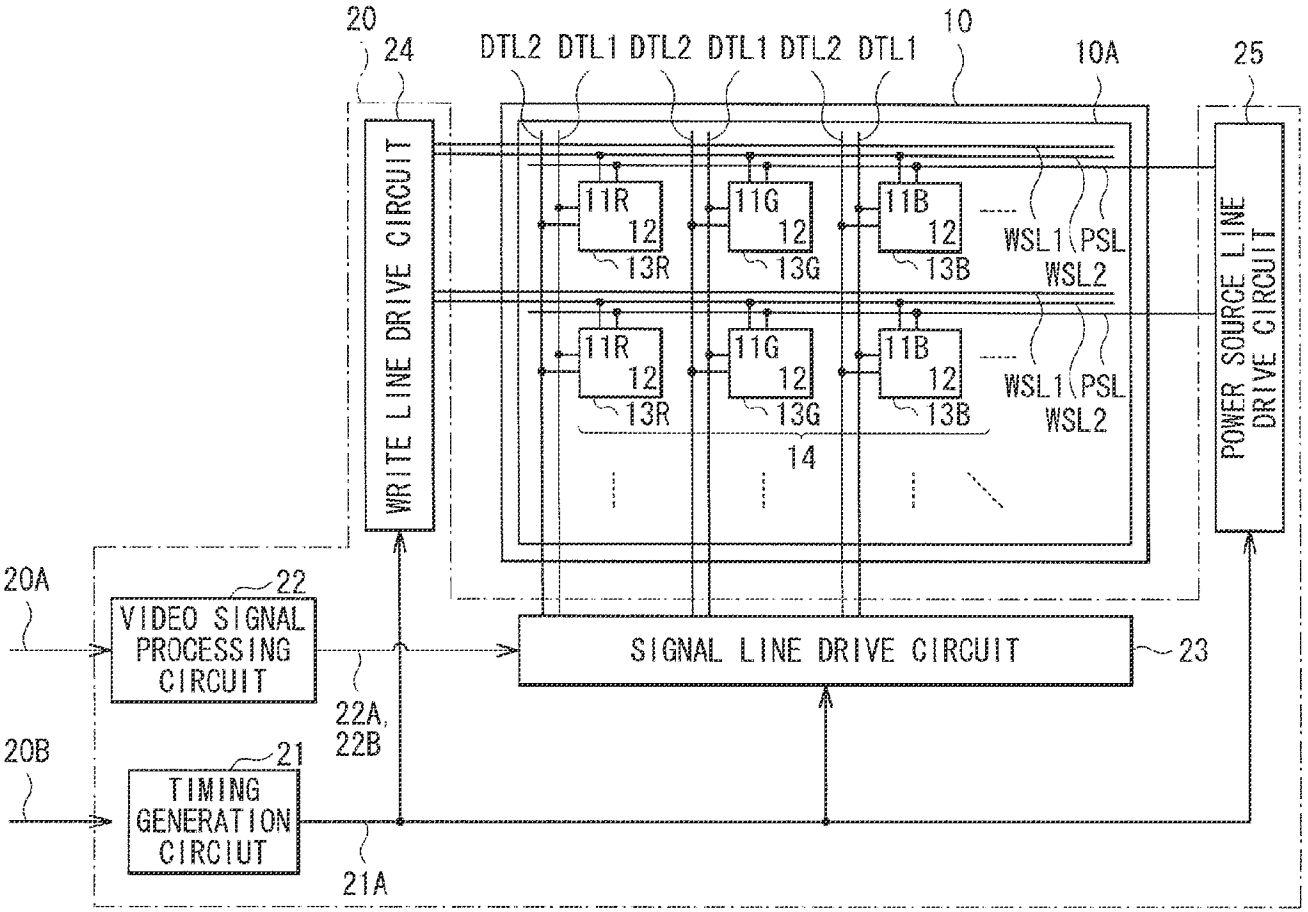
FIG. 1 is a schematic configuration diagram of a display device according to an embodiment of the present disclosure.

FIG. 1 illustrates an example of general configuration of a display device 1 according to an embodiment of the present disclosure. The display device 1 includes a display panel 10, and a drive circuit 20 configured around the display panel 10.

Display Panel 10

The display panel 10 includes a plurality of display pixels 14 two-dimensionally disposed all over a display region 10A of the display panel 10. The display panel 10 drives each of the display pixels 14 in an active-matrix manner to display an image based on an externally inputted video signal 20A. Each display pixel 14 includes a pixel 13R for red, a pixel 13G for green, and a pixel 13B for blue, for example. Hereinafter, "pixel 13" is used as a collective term for the pixels 13R, 13G, and 13B.

The pixel 13R has, for example, an organic EL element 11R, and a pixel circuit 12. The pixel 13G has, for example, an organic EL element 11G, and the pixel circuit 12. The pixel 13B has, for example, an organic EL element 11B, and the pixel circuit 12. The organic EL element 11R is an organic EL element which emits red light, the organic EL element 11G is an organic EL element which emits green light, and the organic EL element 11B is an organic EL element which emits blue light. Hereinafter, "organic EL element 11" is used as a collective term for the organic EL elements 11R, 11G, and 11B. It is to be noted that, each of the organic EL elements 11R, 11G, and 11B corresponds to a specific example of "light-emitting element" of the embodiment of the present disclosure.

Although not shown in the figure, the organic EL element 11 has a configuration in which, for example, an anode, an organic layer and a cathode are laminated in order. The organic layer has, for example, a laminated structure in which, a hole injection layer for enhancing hole injection efficiency, a hole transport layer for enhancing hole transport efficiency to a light emitting layer, the light emitting layer for generating light through electron-hole recombination, and an electron transport layer for enhancing electron transport efficiency to the light emitting layer are laminated in the order starting from the anode side.

Figure 2:
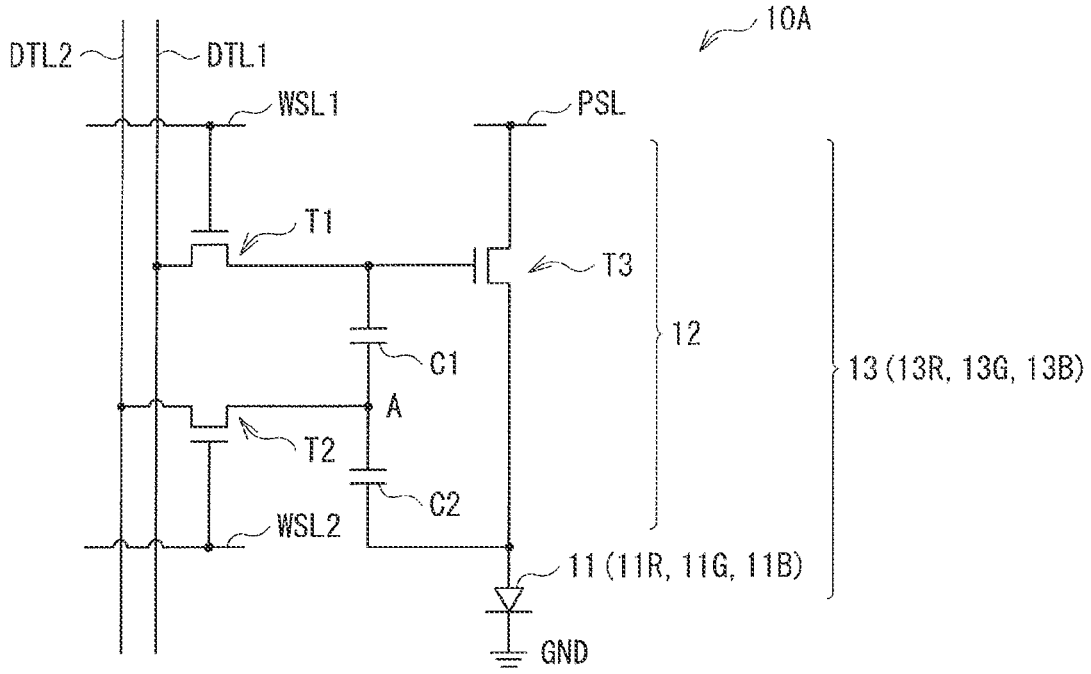
FIG. 2 is a circuit diagram of a pixel of FIG. 1.

As shown in FIG. 2, the pixel circuit 12 has, for example, transistors T1, T2, and T3, and holding capacitors C1 and C2. It is to be noted that, the transistors T1 and T2 correspond to specific examples of "a sampling circuit" of the present disclosure, and the transistor T3 corresponds to a specific example of "a drive circuit" of the present disclosure. In addition, the holding capacitors C1 and C2 correspond to specific examples of "a holding circuit" of the present disclosure.

The transistor T1 samples a voltage of the signal line DTL1 and writes the voltage in a gate of the transistor T3. The transistor T2 samples a voltage of the signal line DTL2 and writes the voltage in a connection point A between the holding capacitor C1 and the holding capacitor C2. Based on the voltage in the holding capacitors C1 and C2 written by the transistors T1 and T2, the transistor T3 drives the organic EL element 11 (the transistor T3 controls the current flowing through the organic EL element 11). The holding capacitors C1 and C2 hold the voltage sampled by the transistors T1 and T2, and holds a predetermined voltage between the gate and a source of the transistor T3. Each of the transistors T1, T2, and T3 is configured of a thin-film transistor (TFT) of an n channel MOS type, for example. It is to be noted that, each of the transistors T1, T2, and T3 may be configured of a TFT of a p channel MOS type.

The display panel 10 has pairs of write lines WSL1 and WSL2 extending in the row direction, pairs of signal lines DTL1 and DTL2 extending in the column direction, a plurality of power source lines PSL extending in the row direction, and a power source line GND. In the proximity of the intersection of each signal line DTL1 and each write line WSL1, the pixel 13 is provided. Each signal line DTL1 is connected to an output terminal (not shown) of a signal line drive circuit 23 described later and a source or a drain of the transistor T1. Each signal line DTL2 is connected to an output terminal (not shown) of the signal line drive circuit 23 described later and a source or a drain of the transistor T2. Each write line WSL1 is connected to an output terminal (not shown) of a write line drive circuit 24 described later and a gate of the transistor T1. Each write line WSL2 is connected to an output terminal (not shown) of the write line drive circuit 24 described later and a gate of the transistor T2. Each power source line PSL is connected to an output terminal (not shown) of a power source which outputs a fixed voltage Vcc and the source or the drain of the transistor T3. The power source line GND is connected to a wiring (not shown) which is set to a voltage Vcat (for example, ground potential) corresponding to a reference potential and the cathode of the organic EL element 11.

The gate of the transistor T1 is connected to the write line WSL1. The source or the drain of the transistor T1 is connected to the signal line DTL1, and one of the source and the drain of the transistor T1 which is not connected to the signal line DTL1 is connected to the gate of the transistor T3. The gate of the transistor T2 is connected to the write line WSL2. The source or the drain of the transistor T2 is connected to the signal line DTL2, and one of the source and the drain of the transistor T2 which is not connected to the signal line DTL2 is connected to the connection point A. The source or the drain of the transistor T3 is connected to the power source line PSL, and one of the source and the drain of the transistor T3 which is not connected to the power source line PSL is connected to the anode of the organic EL element 11. One end of the holding capacitor C1 is connected to the gate of the transistor T3, and the other end of the holding capacitor C1 is connected to one end of the holding capacitor C2. The other end of the holding capacitor C2 is connected to one of the source and the drain of the transistor T3 which is not connected to the power source line PSL. In other words, the holding capacitors C1 and C2 are serially inserted between the gate and the source of the transistor T3. The anode of the organic EL element 11 is connected to one of the source and the drain of the transistor T3 which is not connected to the power source line PSL, and the cathode of the organic EL element 11 is connected to the power source line GND.

Drive Circuit 20

As shown in FIG. 1, the drive circuit 20 has, for example, a timing generation circuit 21, a video signal processing circuit 22, the signal line drive circuit 23, the write line drive circuit 24, and the power source line drive circuit 25.

The timing generation circuit 21 controls the video signal processing circuit 22, the signal line drive circuit 23, the write line drive circuit 24, and the power source line drive circuit 25 to operate in conjunction with one another. In response to (or, in synchronization with) an externally-inputted synchronizing signal 20B, for example, the timing generation circuit 21 outputs a control signal 21A to the above-described circuits.

The video signal processing circuit 22 carries out a predetermined correction of an externally-inputted digital video signal 20A, and converts the corrected video signal into an analog signal and outputs the signal to the signal line drive circuit 23. The predetermined correction includes a gamma correction, an overdrive correction, and the like. Further, the video signal processing circuit 22 generates, from the video signal 20A, a video signal 22A to be outputted to the signal line DTL1, and a video signal 22B to be outputted to the signal line DTL2.

In response to (or, in synchronization with) an input of the control signal 21A, the signal line drive circuit 23 outputs the video signal 22A inputted from the video signal processing circuit 22 to each signal line DTL1. Meanwhile, in response to (or, in synchronization with) an input of the control signal 21A, the signal line drive circuit 23 outputs the video signal 22B, which is an analog signal, inputted from the video signal processing circuit 22 to each signal line DTL2. The signal line drive circuit 23 may, for example, output three kinds of voltages (Vofs, Vsig1, and Vsig2) according to an input of the control signal 21A. Specifically, through the signal line DTL1, the signal line drive circuit 23 regularly supplies a pixel 13 selected by the write line drive circuit 24 with two kinds of voltages (Vofs and Vsig1). Further, through the signal line DTL2, the signal line drive circuit 23 regularly supplies a pixel 13 selected by the write line drive circuit 24 with two kinds of voltages (Vofs and Vsig2).

Figure 16:
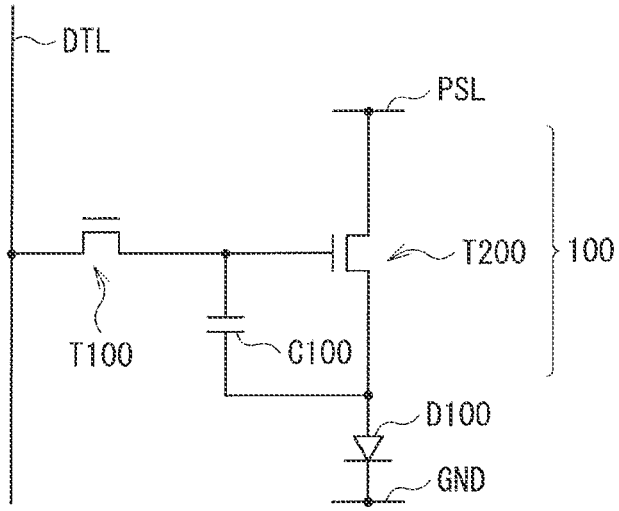
FIG. 16 is a diagram illustrating an exemplary structure of a pixel of the related art.
Figure 17:
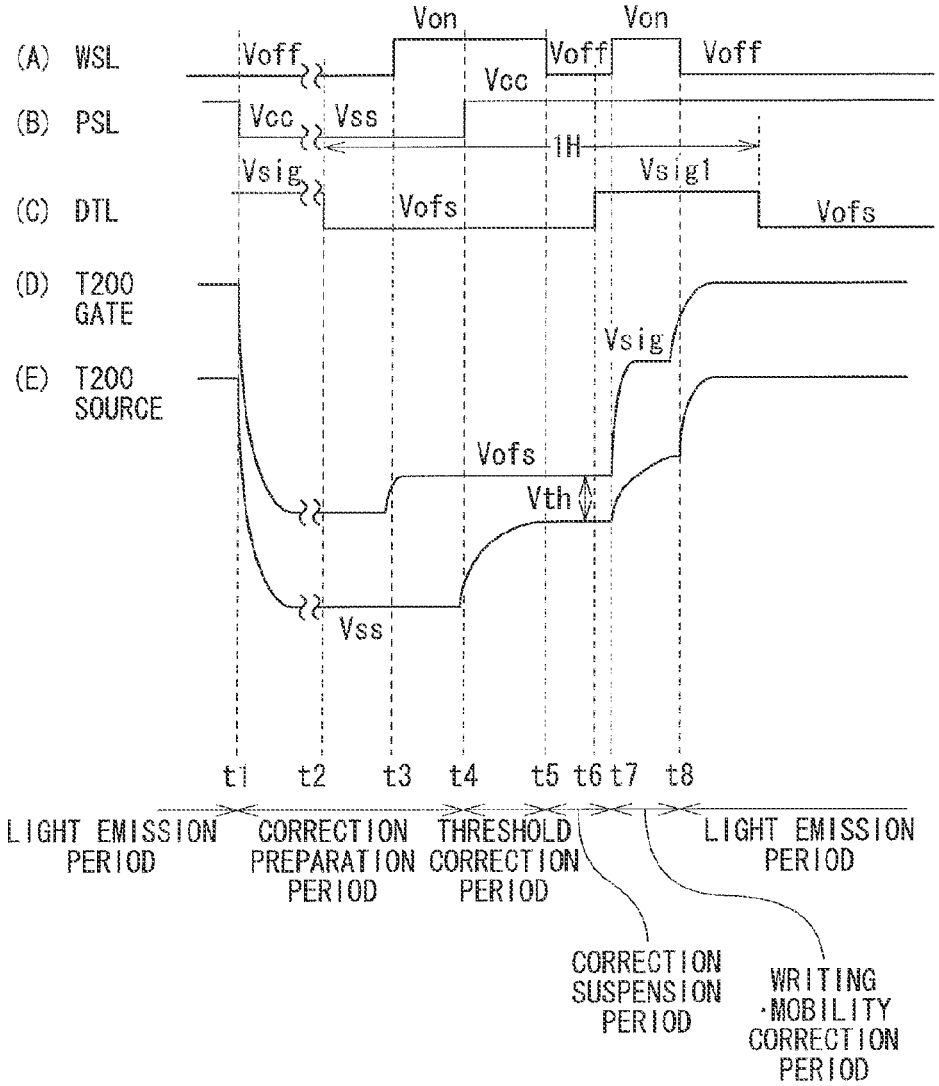
FIG. 17 is a waveform diagram illustrating an exemplary operation of a display device including a pixel of the related art.

Here, the voltage Vofs is a basic voltage, and is set to a voltage value lower than the threshold voltage of the organic EL element 11. The voltage Vofs is set to a value such that Vofs−Vss is higher than a threshold voltage Vth of the transistor T3. In addition, each of the voltages Vsig1 and Vsig2 is set to a voltage value commensurate with a gray-scale. The maximum value of each of the voltages Vsig1 and Vsig2 is set to a value lower than the maximum value of a voltage outputted to the signal line DTL provided corresponding to the pixel circuit 100 of known type shown in FIG. 16.

In response to (or, in synchronization with) an input of the control signal 21A, the write line drive circuit 24 sequentially selects a plurality of the write lines WSL1 on a predetermined unit basis (for example, one at a time), and sequentially selects a plurality of the write lines WSL2 on a predetermined unit basis (for example, one at a time). The write line drive circuit 24 may output two kinds of voltages (Von and Voff) in response to an input of the control signal 21A, for example. Specifically, through the write line WSL1, the write line drive circuit 24 supplies a pixel 13 to be driven with two kinds of voltages (Von and Voff), and, through the write line WSL2, supplies a pixel 13 to be driven with two kinds of voltages (Von and Voff).

Here, the voltage Von is set to a value higher than the on voltage of the transistors Tr1 and T2. The voltage Voff is set to a value lower than the on voltage of the transistors Tr1 and T2.

The power source line drive circuit 25 is capable of outputting two kinds of voltages (Vcc and Vss) in response to (or, in synchronization with) an input of the control signal 21A. Specifically, through the power source line PSL, the power source line drive circuit 25 supplies a pixel 13 to be driven with two kinds of voltages (Vcc and Vss).

Here, the voltage Vss is set to a voltage value lower than a voltage which is the sum of the threshold voltage of the organic EL element 11 and the cathode voltage of the organic EL element 11. The voltage Vss is set to such a value that Vofs−Vss is larger than the threshold voltage Vth of the transistor T3. In addition, the voltage Vcc is set to a voltage value higher than a voltage which is the sum of the threshold voltage of the organic EL element 11 and the cathode voltage of the organic EL element 11.

Operation

Next, operations (operations from turning off to turning on of light) of the display device 1 of the present embodiment will be described. The present embodiment incorporates a compensation operation for a variation in I-V characteristics of the organic EL element 11 and a correction operation for a variation in the threshold voltage and the mobility of the transistor T3 so that, even in the case where I-V characteristics of the organic EL element 11 is changed over time, or where the threshold voltage and the mobility of the transistor T3 are changed over time, the light-emission luminance of the organic EL element 11 may be kept constant without being affected by the changes over time.

Figure 3:
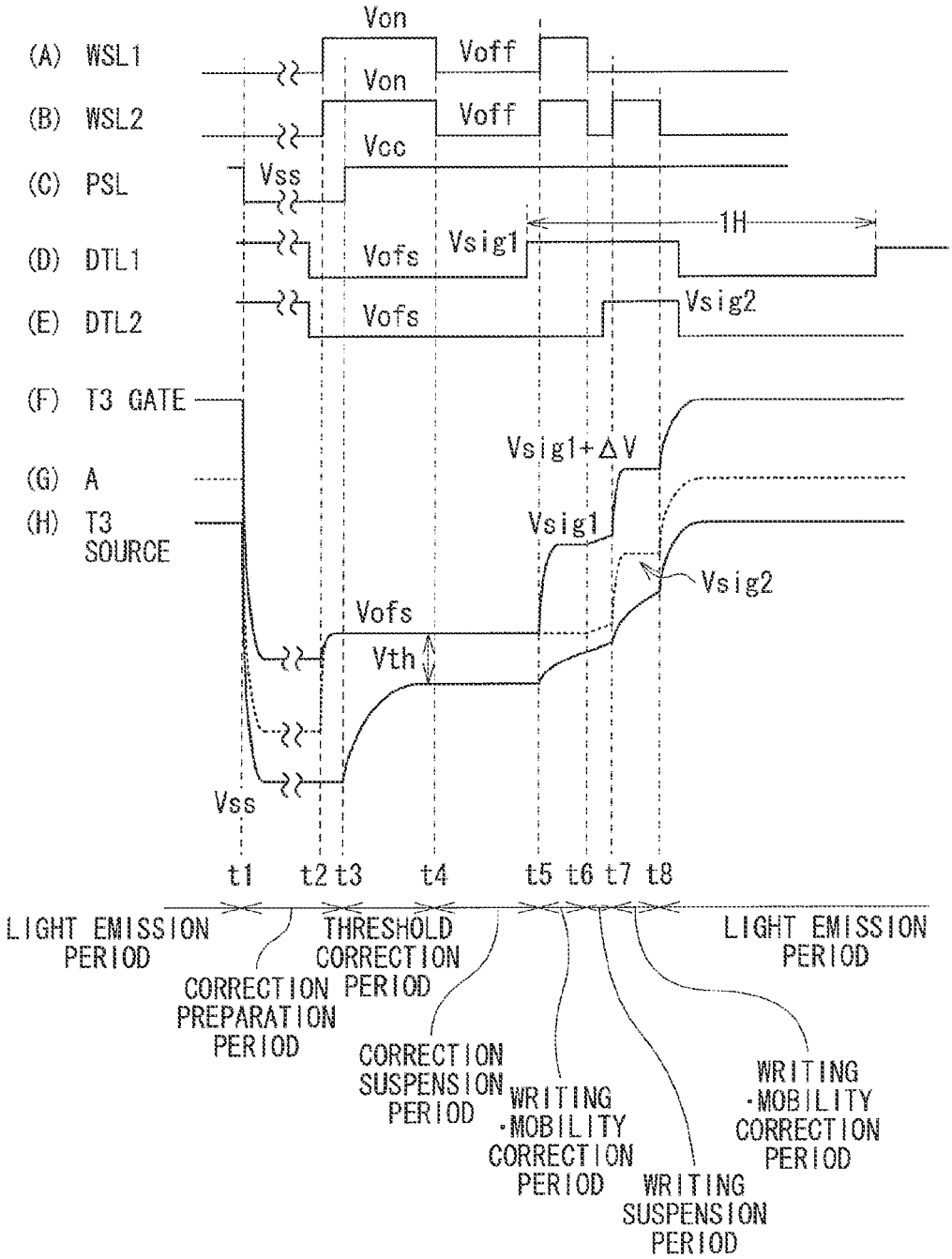
FIG. 3 is a waveform diagram illustrating an exemplary operation of the display device of FIG. 1.

FIG. 3 illustrates exemplary waveforms of voltages applied to one of the pixels 13 of the display device 1. Specifically, FIG. 3 shows a state where two kinds of voltages (Vcc and Vss) are applied to the power source line PSL, and three kinds of voltages (Vofs, Vsig1, and Vsig2) are applied to the signal lines DTL1 and DTL2, and two kinds of voltages (Von and Voff) are applied to the write lines WSL1 and WSL2. Further, FIG. 3 shows temporal changes of the gate voltage Vg and the source voltage Vs of the transistor T3, and the voltage of the connection point A in response to applications of voltage to the power source line PSL, the signal lines DTL, and the write lines WSL.

Light Emission Period

Firstly, during a light emission period, the transistors T1 and T2 are in an off state, and the transistor T3 operates in a saturation region. Therefore, a current corresponding to the voltage between the gate and the the source of the transistor T3 flows through the organic EL element 11, and the organic EL element 11 emits light with luminance corresponding to the current value.

Correction Preparation Period

Next, preparations for threshold correction are made. Specifically, the power source line drive circuit 25 decreases the voltage of the power source line PSL from Vcc to Vss (t1). Then, the source voltage Vs becomes Vss, and the light emission of the organic EL element 11 is stopped. Next, the signal line drive circuit 23 switches the voltage of the signal line DTL1 from Vsig1 to Vofs, and switches the voltage of the signal line DTL2 from Vsig2 to Vofs. Thereafter, while the voltage of the power source line PSL is Vss, the write line drive circuit 24 raises the voltages of the write lines WSL1 and WSL2 from Voff to Von (t2). Then, the signal line DTL1 is connected to the gate of the transistor T3, and the signal line DTL2 is connected to the connection point A. As a result, the gate voltage Vg of the transistor T3 becomes Vofs, and the voltage of the connection point A also becomes Vofs. At this time, the voltage between the gate and the source of the transistor T3 (Vofs−Vss) is higher than the threshold voltage Vth of the transistor T3.

Threshold Correction Period

Figure 4:
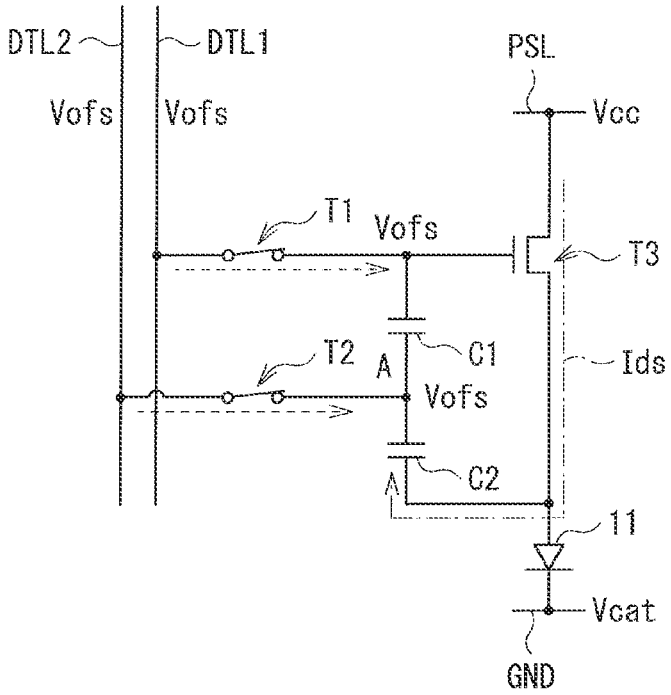
FIG. 4 is a circuit diagram illustrating an exemplary operation of the display device of FIG. 1.

Next, a threshold correction is carried out. Specifically, while the voltages of the signal lines DTL1 and DTL2 are Vofs, the power source line drive circuit 25 raises the voltage of the power source line PSL from Vss to Vcc (t3). Then, as shown in FIG. 4, the current Ids flows between the drain and the source of the transistor T3 to raise the source voltage Vs of the transistor T3. After the lapse of a certain period of time, the voltage between the gate and the source of the transistor T3 becomes Vth. At this time, when the anode voltage of the organic EL element 11 is represented by Ve1, the following relationship holds: Ve1=Vofs−Vth<Vcat+Vthe1 where Vcat represents the cathode voltage of the organic EL element 11, and Vthe1 represents the threshold voltage of the organic EL element 11. Therefore, the organic EL element 11 is in a cut-off state.

Thereafter, before the signal line drive circuit 23 switches the voltage of the signal line DTL1 from Vofs to Vsig1, the write line drive circuit 24 decreases the voltages of the write lines WSL1 and WSL2 from Von to Voff (t4). Then, the gate of the transistor T3 is set to a floating state, and the threshold correction is temporarily stopped.

Correction Suspension Period

During a period in which the threshold correction is suspended, a sampling of the voltages of the signal lines DTL1 and DTL2 is carried out at another row (pixel 13) different from the row (pixel 13) which has undergone the threshold correction.

Writing•Mobility Correction Period

After the correction suspension period is finished, a first writing•mobility correction is carried out. Specifically, after the signal line drive circuit 23 switches the voltage of the signal line DTL1 from Vofs to Vsig1, the write line drive circuit 24 raises the voltage of the write lines WSL1 and WSL2 from Voff to Von (t5) to connect the gate of the transistor T3 to the signal line DTL1. At this time, at least until the voltages of the write lines WSL1 and WSL2 are decreased from Von to Voff by the write line drive circuit 24, the signal line drive circuit 23 maintains the voltage of the signal line DTL2 at Vofs. It is to be noted that, the first writing•mobility correction corresponds to a specific example of "a first sampling" of the present disclosure.

Figure 5:
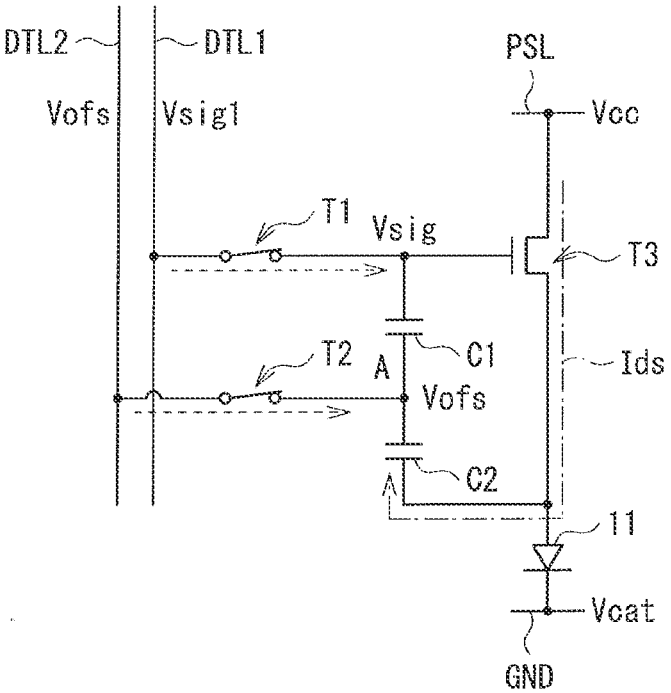
FIG. 5 is a circuit diagram illustrating an exemplary operation following FIG. 4.

Then, as shown in FIG. 5, the gate voltage of the transistor T3 becomes Vsig1. At this time, the anode voltage of the organic EL element 11 at this stage is still lower than the threshold voltage of the organic EL element 11, and the organic EL element 11 is in a cut-off state. Therefore, since the current Ids flows through a capacitor element (not shown) of the organic EL element 11 to charge the capacitor element, the source voltage Vs of the transistor T3 gradually rises. At this time, if the source voltage Vs of the transistor T3 does not exceed the sum of the threshold voltage of the organic EL element 11 and the cathode voltage of the organic EL element 11 (that is, if the leak current of the organic EL element 11 is considerably lower than the current flowing through the transistor T3), the current of the transistor T3 is used to charge the parasitic capacitance of the holding capacitor C2 and the organic EL element 11. Meanwhile, at this time, the threshold correction of the transistor T3 is already completed, so that the current flowing through the transistor T3 corresponds to the mobility μ of the transistor T3. Thereafter, the write line drive circuit 24 decreases the voltages of the write lines WSL1 and WSL2 from Von to Voff (t6) to turn off the transistors T1 and T2.

Writing Suspension Period

During a period in which the writing is suspended, the signal line drive circuit 23 switches the voltage of the signal line DTL2 from Vofs to Vsig2. At this time, the signal line drive circuit 23 maintains the voltage of the signal line DTL1 at Vsig1.

Figure 6:
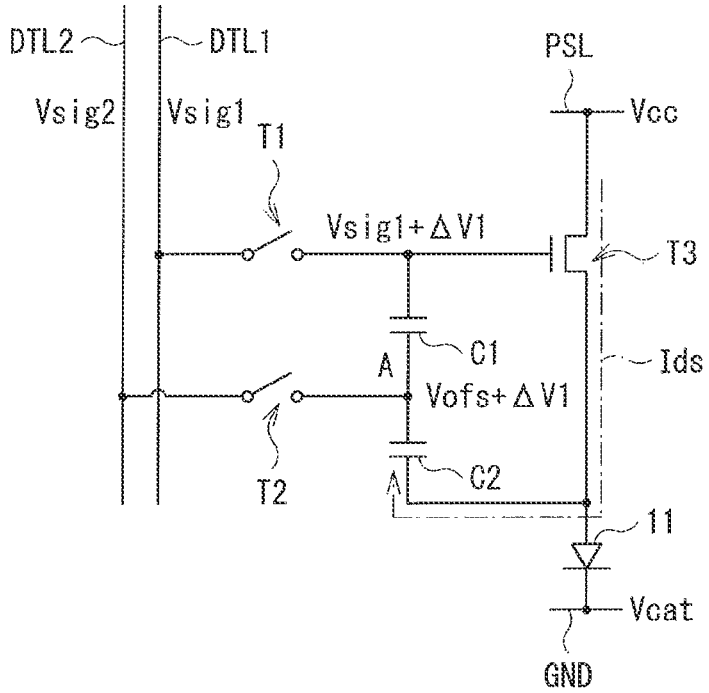
FIG. 6 is a circuit diagram illustrating an exemplary operation following FIG. 5.

Incidentally, while the transistors T1 and T2 are in an off state, the source voltage Vs of the transistor T3 continues to rise. Along with the rising of the source voltage Vs, the voltage of the connection point A between the holding capacitors C1 and C2 and the gate voltage Vg of the transistor T3 are also raised. The increment at this time is represented by ΔV1 (see FIG. 6). At this time, if the source voltage Vs of the transistor T3 does not exceed the sum of the threshold voltage of the organic EL element 11 and the cathode voltage of the organic EL element 11, then the organic EL element 11 does not emit light.

Writing•Mobility Correction Period

After the writing suspension period is finished, a second writing•mobility correction is carried out. Specifically, the write line drive circuit 24 raises the voltage of the write line WSL2 from Voff to Von (t7), and connects the connection point A between the holding capacitors C1 and C2 to the signal line DTL2. At this time, at least until the voltage of the write line WSL2 is decreased from Von to Voff, the write line drive circuit 24 maintains the voltage of the write line WSL1 at Voff. It is to be noted that, the second writing•mobility correction corresponds to a specific example of "a second sampling" of the present disclosure.

Figure 7:
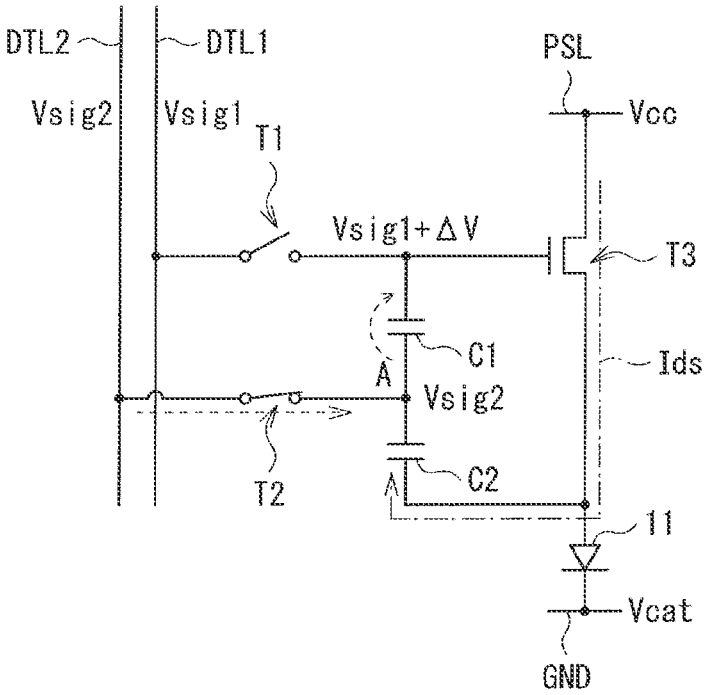
FIG. 7 is a circuit diagram illustrating an exemplary operation following FIG. 6.

Thus, when the voltage written in the gate of the transistor T3 by the first writing•mobility correction is held in the holding capacitor C1 (that is, when the record of the first writing•mobility correction is held), the variation in voltage at the connection point A is inputted to the gate of the transistor T3 through the holding capacitor C1. Therefore, as shown in FIG. 7, the gate voltage Vg of the transistor T3 is raised by ΔV in accordance to the amount of variation in voltage at the connection point A, and becomes Vsig1+ΔV. As a result, again, the mobility correction of the transistor T3 is started to raise the source voltage Vs of the transistor T3.

Light Emission Period

After the lapse of a certain period of time, the write line drive circuit 24 decreases the voltage of the write line WSL2 from Von to Voff (t8). Then, the gate of the transistor T3 is set to a floating state, and the current Ids flows between the drain and the source of the transistor T3 to raise the source voltage Vs. As a result, the organic EL element 11 emits light with a desired luminance. It is to be noted that, in the light emission period, the signal amplitude inputted to the pixel 13 is Vsig1+ΔV−Vofs, which is larger than Vsig1−Vofs.

Effect

Next, an effect of the display device 1 is described. In the present embodiment, the voltage of the signal line DTL1 is sampled by the transistor T2, and written in the gate of the transistor T3. Further, the voltage of the signal line DTL2 is sampled by the transistor T2, and written in the holding capacitor C1. Thus, the gate voltage Vg of the transistor T1 may be raised to a voltage higher than the voltage of the signal line DTL1 to turn on the transistor T1. As a result, in the light emission period described above, the voltage inputted between the gate and the source of the transistor T1 may be set to a voltage higher than Vsig1−Vofs (i.e., Vsig1+ΔV−Vofs). Accordingly, if Vsig1 is the maximum output voltage of the signal line drive circuit 23, a voltage higher than the maximum output voltage of the signal line drive circuit 23 is inputted to the pixel 13. In other words, the amplitude of the signal line drive circuit 23 may be spuriously made large by the pixel circuit 12. Specifically, an effect similar to increasing the output of the signal line drive circuit 23 which applies the voltage to the signal lines DTL1 and DTL2 may be obtained. Consequently, high-luminance may be obtained while suppressing the power consumption of the signal line drive circuit 23.

2. Modification

First Modification

In the above-described embodiment, although the second writing•mobility correction is carried out before 1H elapses from the start of the first writing•mobility correction, the second writing•mobility correction may be carried out after 1H has elapsed from the start of the first writing•mobility correction. Even in this case, similarly to the above-described embodiment, it is possible to obtain the effect similar to increasing the output of the signal line drive circuit 23 which applies the voltage to the signal lines DTL1 and DTL2.

Second Modification

Figure 8:
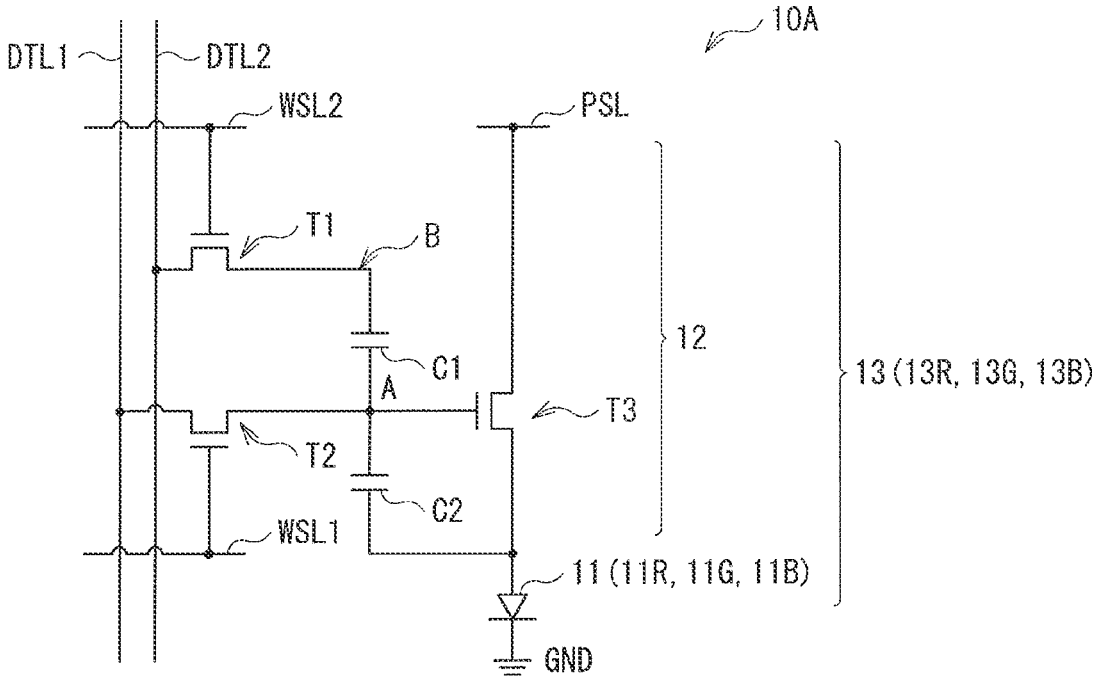
FIG. 8 is a circuit diagram of a modification of the pixel of FIG. 2.

For example, as shown in FIG. 8, in the above-described embodiment, the gate of the transistor T3 may be connected to the connection point A between the holding capacitors C1 and C2, and the gate of the transistor T1 may be connected to the write line WSL2, and the gate of the transistor T2 may be connected to the write line WSL1. Further, as shown in FIG. 8, the signal line DTL2 may be connected to one of the source and the drain of the transistor T1 which is not connected to the holding capacitor C1, and the signal line DTL1 may be connected to one of the source and drain of the transistor T2 which is not connected to the gate of the transistor T3.

Operation

Figure 9:
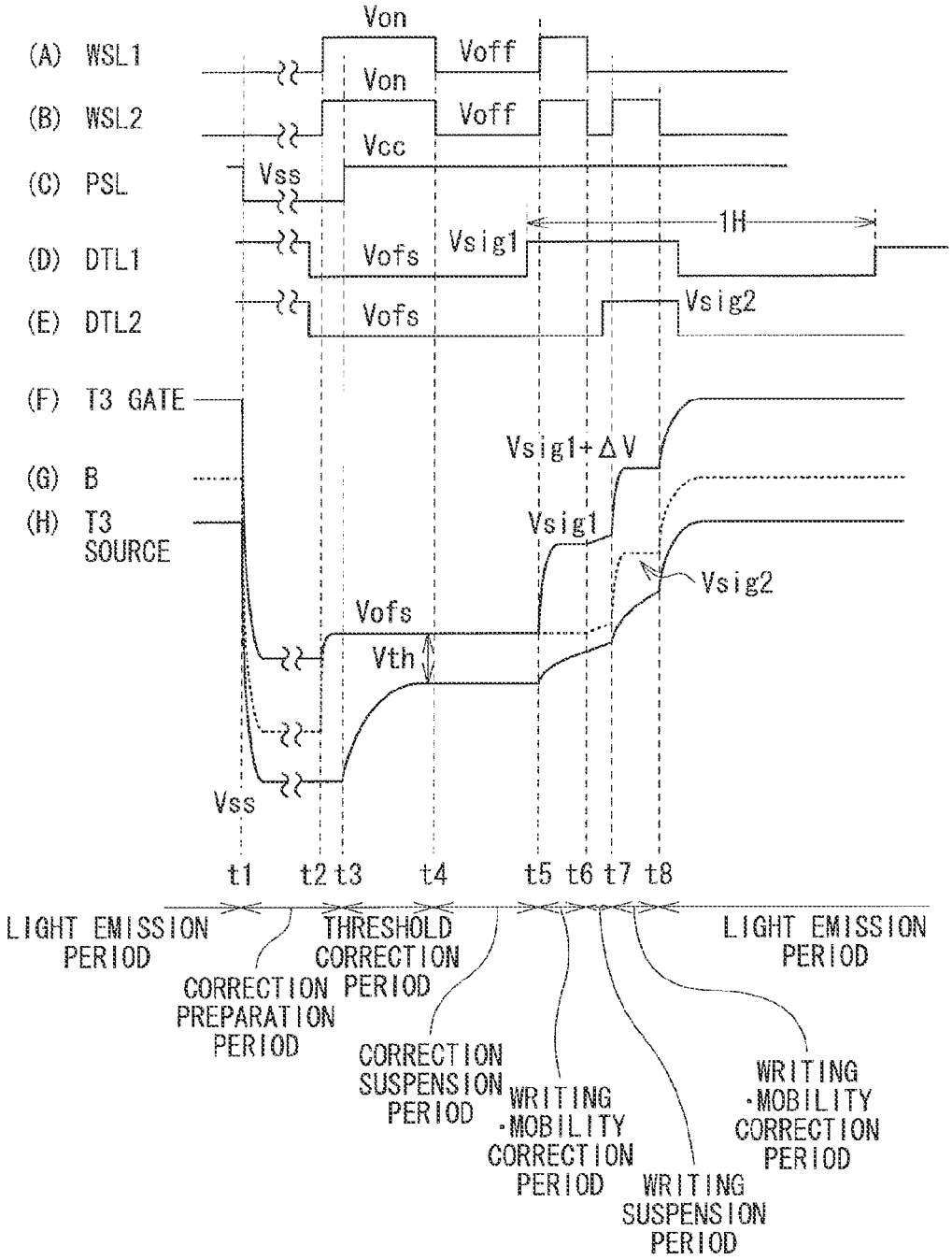
FIG. 9 is a waveform diagram illustrating an exemplary operation of a display device including the pixel of FIG. 8.

Next, an operation (operation from turning off to turning on of light) of a display device 1 according to the present modification is described. FIG. 9 illustrates exemplary voltage waveforms applied to a pixel 13 of the display device 1 according to the present modification. Specifically, FIG. 9 shows a state where two kinds of voltages (Vcc and Vss) are applied to a power source line PSL, three kinds of voltages (Vofs, Vsig1, and Vsig2) are applied to signal lines DTL1 and DTL2, and two kinds of voltages (Von and Voff) are applied to a write line WSL. Further, FIG. 9 shows temporal changes of a gate voltage Vg and a source voltage Vs of the transistor T3, and a voltage of a connection point B in response to voltages applied to the power source line PSL, the signal line DTL, and the write line WSL.

Light Emission Period

Firstly, during a light emission period, transistors T1 and T2 are in an off state, and a transistor T3 operates in a saturation region. Therefore, a current corresponding to the voltage between the gate and the source of the transistor T3 flows through an organic EL element 11, and the organic EL element 11 emits light with luminance corresponding to the current value.

Correction Preparation Period

Next, preparations for threshold correction is made. Specifically, a power source line drive circuit 25 decreases the voltage of the power source line PSL from Vcc to Vss (t1). Then, the source voltage Vs becomes Vss, and the organic EL element 11 is turned off. Next, a signal line drive circuit 23 switches the voltage of the signal line DTL1 from Vsig1 to Vofs, and switches the voltage of the signal line DTL2 from Vsig2 to Vofs. Thereafter, while the voltage of the power source line PSL is Vss, a write line drive circuit 24 raises the voltage of the write lines WSL1 and WSL2 from Voff to Von (t2). Then, the signal line DTL1 is connected to the gate of the transistor T3, and the signal line DTL2 is connected to the connection point B between the transistor T1 and a holding capacitor C1. As a result, the gate voltage Vg of the transistor T3 becomes Vofs, and the voltage of the connection point B also becomes Vofs. At this time, the voltage between the gate and the source of the transistor T3 (Vofs−Vss) is larger than the threshold voltage Vth of the transistor T3.

Threshold Correction Period

Next, a threshold correction is carried out. Specifically, while the voltages of the signal lines DTL1 and DTL2 are Vofs, the power source line drive circuit 25 raises the voltage of the power source line PSL from Vss to Vcc (t3). Then, a current Ids flows between the drain and the source of the transistor T3 to raise the source voltage Vs of the transistor T3. After the lapse of a certain period of time, the voltage between the gate and the source of the transistor T3 becomes Vth. At this time, when an anode voltage of the organic EL element 11 is represented by Ve1, the following expression holds: $Ve1=Vofs-Vth\leq Vcat+Vthe1$. Therefore, the organic EL element 11 is in a cut-off state.

Thereafter, before the signal line drive circuit 23 switches the voltage of the signal line DTL1 from Vofs to Vsig1, the write line drive circuit 24 decreases the voltages of the write lines WSL1 and WSL2 from Von to Voff (t4). Then, the gate of the transistor T3 is set to a floating state, and the threshold correction is temporarily stopped.

Correction Suspension Period

During a period in which the threshold correction is suspended, a sampling of the voltages of the signal lines DTL1 and DTL2 is carried out at another row (pixel 13) different from the row (pixel 13) which has undergone the threshold correction.

Writing•Mobility Correction Period

After the correction suspension period is finished, a first writing•mobility correction is carried out. Specifically, after the signal line drive circuit 23 switches the voltage of the signal line DTL1 from Vofs to Vsig1, the write line drive circuit 24 raises the voltages of the write lines WSL1 and WSL2 from Voff to Von (t5) to connect the gate of the transistor T3 to the signal line DTL1. At this time, at least until the voltages of the write lines WSL1 and WSL2 are decreased from Von to Voff by the write line drive circuit 24, the signal line drive circuit 23 maintains the voltage of the signal line DTL2 at Vofs. It is to be noted that, the first writing•mobility correction corresponds to a specific example of "a first sampling" of the present disclosure.

Then, the gate voltage Vg of the transistor T3 becomes Vsig1. At this time, the anode voltage of the organic EL element 11 at this stage is still lower than the threshold voltage of the organic EL element 11, and the organic EL element 11 is in a cut-off state. Therefore, since the current Ids flows through a capacitor element (not shown) of the organic EL element 11 to charge the capacitor element, the source voltage Vs of the transistor T3 gradually rises. At this time, if the source voltage Vs of the transistor T3 does not exceed the sum of the threshold voltage of the organic EL element 11 and the cathode voltage of the organic EL element 11 (that is, if the leak current of the organic EL element 11 is considerably lower than the current flowing through the transistor T3), the current of the transistor T3 is used to charge the parasitic capacitance of the holding capacitor C2 and the organic EL element 11. Meanwhile, at this time, the threshold correction of the transistor T3 is already completed, so that the current flowing through the transistor T3 corresponds to the mobility μ of the transistor T3. Thereafter, the write line drive circuit 24 decreases the voltage of the write lines WSL1 and WSL2 from Von to Voff (t6) to turn off the transistors T1 and T2.

Writing Suspension Period

During a period in which the writing is suspended, the signal line drive circuit 23 switches the voltage of the signal line DTL2 from Vofs to Vsig2. At this time, the signal line drive circuit 23 maintains the voltage of the signal line DTL1 at Vsig1.

Incidentally, while the transistors T1 and T2 are in an off state, the source voltage Vs of the transistor T3 continues to rise. Along with the rising of the source voltage Vs, the voltages of the connection points A and B are also raised. The increment at this time is represented by ΔV1. At this time, if the source voltage Vs of the transistor T3 does not exceed the sum of the threshold voltage of the organic EL element 11 and the cathode voltage of the organic EL element 11, then the organic EL element 11 does not emit light.

Writing•Mobility Correction Period

After the writing suspension period is finished, a second writing•mobility correction is carried out. Specifically, the write line drive circuit 24 raises the voltage of the write line WSL2 from Voff to Von (t7), and connects the connection point B to the signal line DTL2. At this time, at least until the voltage of the write line WSL2 is decreased from Von to Voff, the write line drive circuit 24 maintains the voltage of the write line WSL1 at Voff. It is to be noted that, the second writing•mobility correction corresponds to a specific example of "a second sampling" of the present disclosure.

Thus, when the voltage written in the gate of the transistor T3 by the first writing•mobility correction is held in the holding capacitor C2 (that is, when the record of the first writing•mobility correction is held), the variation in voltage at the connection point B is inputted to the gate of the transistor T3 through the holding capacitor C1. Therefore, the gate voltage of the transistor T3 is raised by ΔV in accordance to the amount of variation in voltage at the connection point B, and becomes Vsig1+ΔV. As a result, again, the mobility correction of the transistor T3 is started to raise the source voltage Vs of the transistor T3.

Light Emission Period

After the lapse of a certain period of time, the write line drive circuit 24 decreases the voltage of the write line WSL2 from Von to Voff (t8). Then, the gate of the transistor T3 is set to a floating state, and the current Ids flows between the drain and the source of the transistor T3 to raise the source voltage Vs. As a result, the organic EL element 11 emits light with a desired luminance. It is to be noted that, in the light emission period, the signal amplitude inputted to the pixel 13 is Vsig1+ΔV−Vofs, which is larger than Vsig1−Vofs.

As described above, the display device 1 of the present modification operates in substantially the same manner as in the above-described embodiment. Accordingly, as is the case with the above-described embodiment, an effect similar to increasing the output of the signal line drive circuit 23 which applies the voltage to the signal lines DTL1 and DTL2 may be obtained also in the present modification. Consequently, high-luminance may be obtained while suppressing the power consumption of the signal line drive circuit 23.

3. Application Example

Hereinafter, application examples of the display device 1 (hereinafter referred to as "the display device 1 of the above-described embodiment and so forth") described in the embodiment and the modifications thereof will be described below. The display device 1 of the above-described embodiment and so forth may be applied to display devices of electronic unit in various fields for displaying an externally inputted video signal or an internally generated video signal as an image or a video. Typical examples of such electronic unit include a television device, a digital camera, a notebook personal computer, a mobile terminal device such as a mobile phone, and a video camera.

Module

Figure 10:
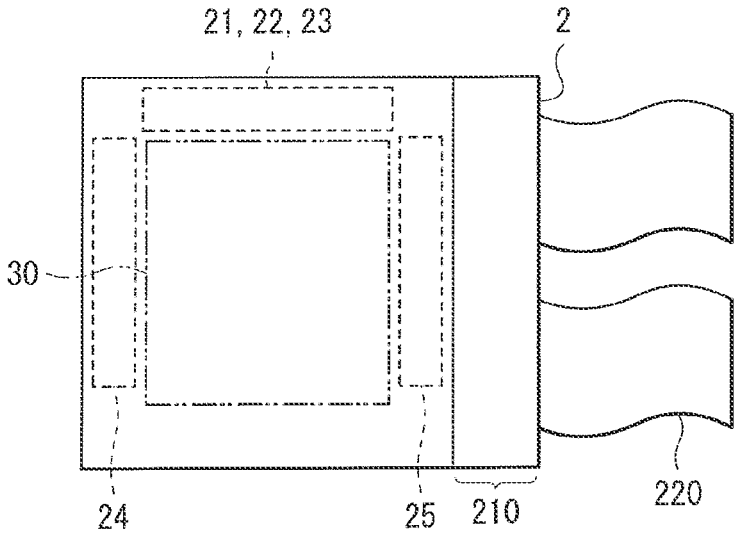
FIG. 10 is a plan view illustrating a schematic configuration of a module including the above-described display device.

The display device 1 of the above-described embodiment and so forth is incorporated in various kinds of electronic unit of a first to fifth application examples described below and the like, as a module shown in FIG. 10, for example. The module shown in FIG. 10 has, for example, a region 210 which is provided on one side of a substrate 2 and exposed from a member (not shown) enclosing a display section 30. Wirings of a timing generation circuit 21, a video signal processing circuit 22, a signal line drive circuit 23, a write line drive circuit 24, and a power source line drive circuit 25 are extended to the exposed region 210 to configure an external connection terminal (not shown). The external connection terminal may be provided with a flexible printed circuit (FPC) 220 for inputting and outputting signals.

First Application Example

Figure 11:
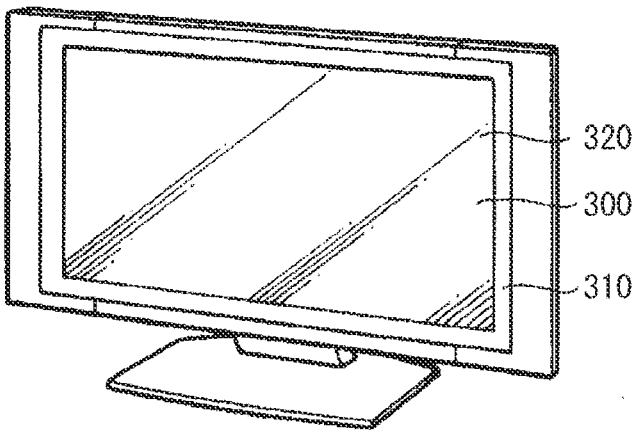
FIG. 11 is a perspective view illustrating an external appearance of a first application example of the above-described display device.

FIG. 11 illustrates an external appearance of a television device to which the display device 1 of the above-described embodiment and so forth is applied. This television device has, for example, a video display screen section 300 including a front panel 310 and a filter glass 320, and the video display screen section 300 is configured of the display device 1 of the above-described embodiment and so forth.

Second Application Example

Figure 12A:
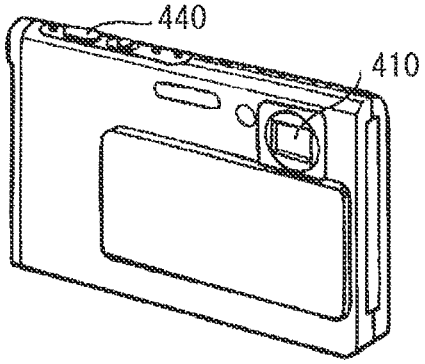
FIG. 12A is a perspective view illustrating an external appearance of a second application example as seen from a front side.
Figure 12B:
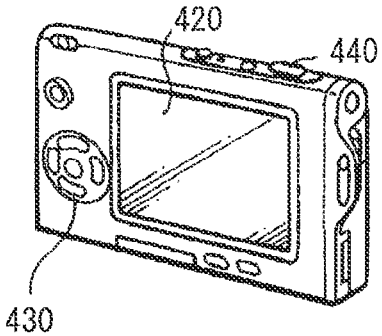
FIG. 12B is a perspective view illustrating an external appearance as seen from a back side.

FIGS. 12A and 12B illustrate external appearances of a digital camera to which the display device 1 of the above-described embodiment and so forth is applied. This digital camera has, for example, a light emitting section 410 for generating flash light, a display section 420, a menu switch 430, and a shutter button 440, and the display section 420 is configured of the display device 1 of the above-described embodiment and so forth.

Third Application Example

Figure 13:
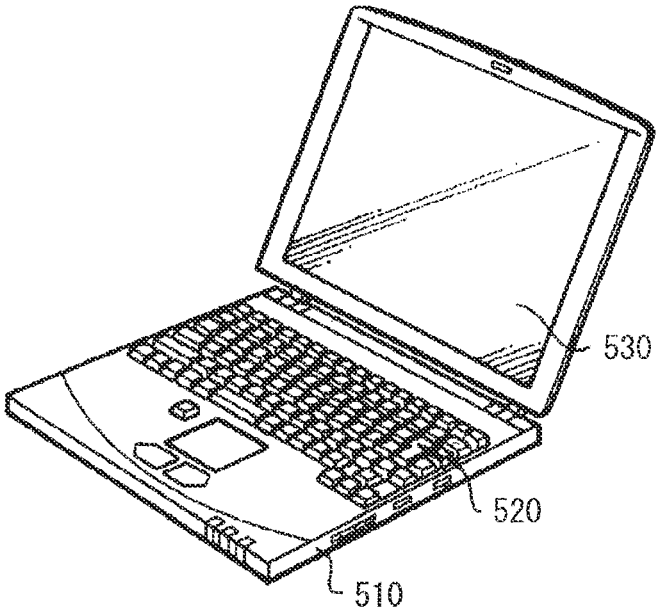
FIG. 13 is a perspective view illustrating an external appearance of a third application example.

FIG. 13 illustrates an external appearance of a notebook personal computer to which the display device 1 of the above-described embodiment and so forth is applied. This notebook personal computer has, for example, a main body 510, a keyboard 520 for input operation of letters and the like, and a display section 530 for displaying images, and the display section 530 is configured of the display device 1 of the above-described embodiment and so forth.

Fourth Application Example

Figure 14:
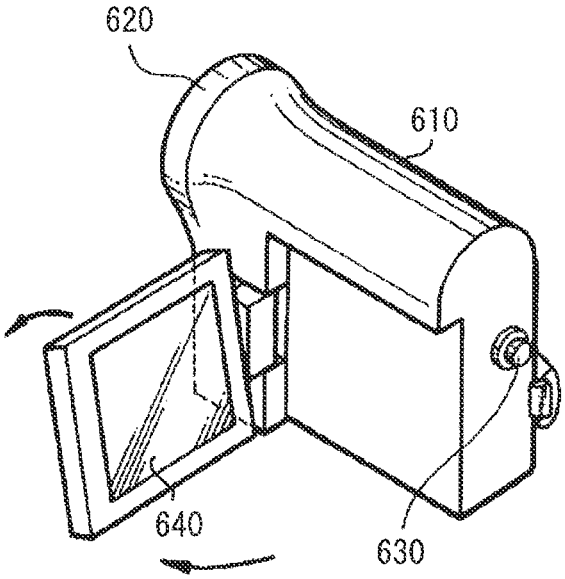
FIG. 14 is a perspective view illustrating an external appearance of a fourth application example.
Figures 15A, 15B, 15C, 15D, 15E, 15F, 15G:
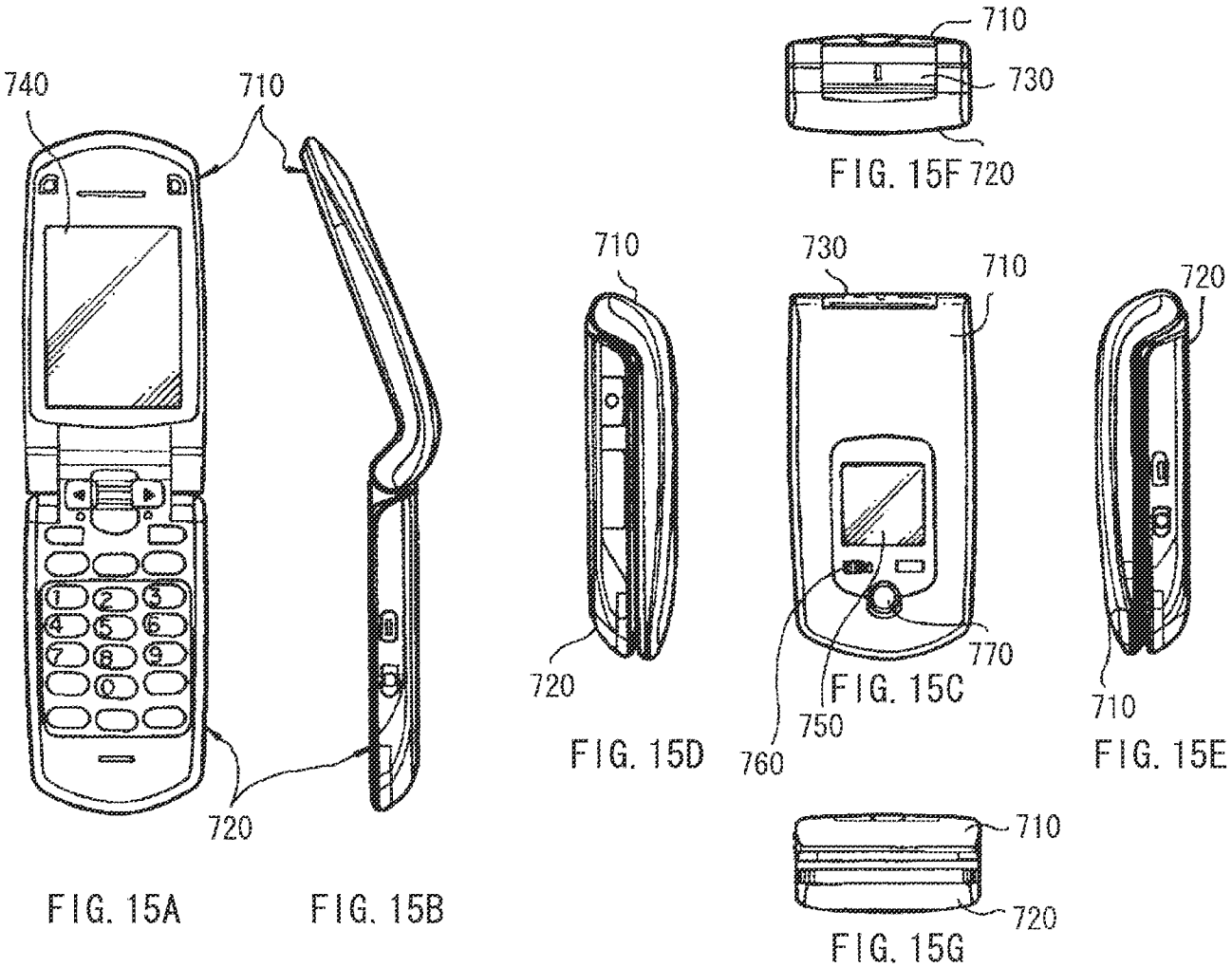
FIGS. 15A to 15G illustrate fifth application example.

FIG. 14 illustrates an external appearance of a video camera to which the display device 1 of the above-described embodiment and so forth is applied. This video camera has, for example, a main body section 610, a lens 620 which is adapted to take an image of a subject and provided on the front side of the main body section 610, a start/stop switch 630 used when capturing an image, and a display section 640, and the display section 640 is configured of the display device 1 of the above-described embodiment and so forth.

Fifth Application Example

FIGS. 15A to 15G illustrate external appearances of a mobile phone to which the display device 1 of the above-described embodiment and so forth is applied. This mobile phone has, for example, an upper housing 710, a lower housing 720, a connecting section (or a hinge section) 730 which connects the upper housing 710 and the lower housing 720, a display 740, a sub-display 750, a picture light 760, and a camera 770. The display 740 or the sub-display 750 is configured of the display device 1 of the above-described embodiment and so forth.

Hereinabove, while the present disclosure is described based on the embodiment, modifications, and application examples, the present disclosure is by no means limited to the above-described embodiment and so forth, and various modifications may be made.

For example, while, in the above-described embodiment and so forth, the case is described where the display device 1 is of an active matrix type, the configuration of the pixel circuit 12 for active matrix drive is not limited to the configuration described in the above-described embodiment and so forth, and a capacitative element and a transistor may be included in the pixel circuit 12 if necessary. For example, in FIG. 2, three or more capacitative elements may be provided between the gate and the source of the transistor T3. Further, in FIG. 8, two or more capacitative elements may be provided between the gate of the transistor T3 and the source of the transistor T1, and two or more capacitative elements may be provided between the gate and the source of the transistor T3, for example.

The present disclosure contains subject matter related to that disclosed in Japanese Priority Patent Application JP 2011-048377 filed in the Japan Patent Office on Mar. 4, 2011, the entire content of which is hereby incorporated by reference.

It should be understood by those skilled in the art that various modifications, combinations, sub-combinations, and alterations may occur depending on design requirements and other factors insofar as they are within the scope of the appended claims or the equivalents thereof.

What is claimed is:

1. A method of driving a pixel circuit, the pixel circuit including a sampling circuit sampling voltages of a first signal line and a second signal line, a holding circuit holding the voltages sampled by the sampling circuit, and a drive circuit driving a light-emitting element based on the voltages held by the holding circuit, the method comprising:

allowing the sampling circuit to perform a first sampling of the voltages of the first signal line and the second signal line, while a first gray-scale voltage is applied to the first signal line and a basic voltage is applied to the second signal line; and allowing the sampling circuit to perform a second sampling of only the voltage of the second signal line, while the voltage obtained by the first sampling is held in the holding circuit and while a second gray-scale voltage is applied to the second signal line, wherein the drive circuit has a driving transistor provided between a fixed power source line and the light-emitting element, the holding circuit has a plurality of holding capacitors which are provided between a gate and a source of the driving transistor and are connected in series with one another, the first sampling allows a gate of the driving transistor to be provided with a first voltage equivalent to the voltage of the first signal line sampled by the sampling circuit, and allows said one of junctions of the holding capacitors to be provided with a second voltage that is equivalent to the voltage of the second signal line sampled by the sampling circuit, and the second sampling allows said one of junctions of the holding capacitors to be provided with a third voltage that is equivalent to the voltage of the second signal line sampled by the sampling circuit, and thus allows a gate voltage of the driving transistor to be raised up to a fourth voltage higher than the first voltage to turn on the driving transistor.

2. The method of claim 1, wherein the method further comprises, prior to the first sampling, allowing the sampling circuit to perform a sampling of the voltages of the first signal line and the second signal line, while the basic voltage is applied to the first and second signal lines, thereby performing a threshold voltage cancellation operation of causing a voltage between the gate and the source of the driving transistor to approach a threshold voltage of the driving transistor.

3. The method of claim 1, wherein the sampling circuit comprises a first sampling transistor that samples the voltages of the first signal line and a second sampling transistor that samples the voltages of the second signal line, the plurality of holding capacitors comprise a first capacitor and a second capacitor, where a first electrode of the first capacitor is connected to the gate of the driving transistor, a second electrode of the first capacitor is connected to a first electrode of the second capacitor, and a second electrode of the second capacitor is connected to the source of the driving transistor, a source or a drain of the first sampling transistor is connected to the gate of the driving transistor, and a source or a drain of the second sampling transistor is connected to the second electrode of the first capacitor.

4. The method of claim 1, wherein the sampling circuit comprises a first sampling transistor that samples the voltages of the first signal line and a second sampling transistor that samples the voltages of the second signal line, the plurality of holding capacitors comprise a first capacitor and a second capacitor, where a first electrode of the first capacitor is connected to a source or a drain of the first sampling transistor, a second electrode of the first capacitor is connected to the gate of the driving transistor and to a first electrode of the second capacitor, and a second electrode of the second capacitor is connected to the source of the driving transistor, a source or a drain of the second sampling transistor is connected to the second electrode of the first capacitor.

5. The method of claim 1, wherein the sampling circuit comprises a first sampling transistor that samples the voltages of the first signal line and a second sampling transistor that samples the voltages of the second signal line, a gate of the first sampling transistor is connected to a first scanning line and a gate of the second sampling transistor is connected to a second scanning line that is different from the first scanning line.

6. A display device including:

a display panel including a plurality of pixels, each of the plurality of pixels including a light-emitting element and a pixel circuit that drives the light-emitting element, the pixel circuit comprising:

a first transistor driving a light-emitting element;

a plurality of holding capacitors connected in series between a gate and a source of the first transistor;

a second transistor provided between a first signal line and the gate of the first transistor; and a third transistor provided between a second signal line and one of junctions of the holding capacitors; and a drive circuit that drives the display panel such that, for a given pixel:

the second and third transistors perform a first sampling of the voltages of the first signal line and the second signal line, respectively, while a first gray-scale voltage is applied to the first signal line and a basic voltage is applied to the second signal line, the third transistor performs a second sampling of the voltage of the second signal line, while the second transistor is in an off state and while the voltage obtained by the first sampling is held in the holding circuit and while a second gray-scale voltage is applied to the second signal line, the first sampling allows a gate of the first transistor to be provided with a first voltage equivalent to the voltage of the first signal line sampled by the second transistor, and allows said one of junctions of the holding capacitors to be provided with a second voltage that is equivalent to the voltage of the second signal line sampled by the third transistor, and the second sampling allows said one of junctions of the holding capacitors to be provided with a third voltage that is equivalent to the voltage of the second signal line sampled by the third transistor, and thus allows a gate voltage of the first transistor to be raised up to a fourth voltage higher than the first voltage to turn on the first transistor.

7. The display device of claim 6, wherein the drive circuit further drives the display panel such that, prior to the first sampling, the second and third transistors sample the voltages of the first signal line and the second signal line, while the basic voltage is applied to the first and second signal lines, thereby performing a threshold voltage cancellation operation of causing a voltage between the gate and the source of the driving transistor to approach a threshold voltage of the driving transistor.

8. The display device of claim 6, wherein the plurality of holding capacitors comprise a first capacitor and a second capacitor, where a first electrode of the first capacitor is connected to the gate of the first transistor, a second electrode of the first capacitor is connected to a first electrode of the second capacitor, and a second electrode of the second capacitor is connected to the source of the driving transistor, a source or a drain of the second transistor is connected to the gate of the first transistor, and a source or a drain of the third transistor is connected to the second electrode of the first capacitor.

9. The display device of claim 6, wherein the plurality of holding capacitors comprise a first capacitor and a second capacitor, where a first electrode of the first capacitor is connected to a source or a drain of the second transistor, a second electrode of the first capacitor is connected to the gate of the first transistor and to a first electrode of the second capacitor, and a second electrode of the second capacitor is connected to the source of the first transistor, a source or a drain of the third transistor is connected to the second electrode of the first capacitor.

10. The display device of claim 6, a gate of the second transistor is connected to a first scanning line and a gate of the third transistors is connected to a second scanning line that is different from the first scanning line.

11. An electronic unit with a display device, the display device including:

a display panel including a plurality of pixels, each of the plurality of pixels including a light-emitting element and a pixel circuit that drives the light-emitting element, the pixel circuit comprising:

a first transistor driving the light-emitting element;

a plurality of holding capacitors connected in series between a gate and a source of the first transistor;

a second transistor provided between a first signal line and the gate of the first transistor; and a third transistor provided between a second signal line and one of junctions of the holding capacitors; and a drive circuit that drives the display panel such that, for a given pixel:

the second and third transistors perform a first sampling of the voltages of the first signal line and the second signal line, respectively, while a first gray-scale voltage is applied to the first signal line and a basic voltage is applied to the second signal line, the third transistor performs a second sampling of the voltage of the second signal line, while the second transistor is in an off state and while the voltage obtained by the first sampling is held in the holding circuit and while a second gray-scale voltage is applied to the second signal line, the first sampling allows a gate of the first transistor to be provided with a first voltage equivalent to the voltage of the first signal line sampled by the second transistor, and allows said one of junctions of the holding capacitors to be provided with a second voltage that is equivalent to the voltage of the second signal line sampled by the third transistor, and the second sampling allows said one of junctions of the holding capacitors to be provided with a third voltage that is equivalent to the voltage of the second signal line sampled by the third transistor, and thus allows a gate voltage of the first transistor to be raised up to a fourth voltage higher than the first voltage to turn on the first transistor.

12. The electronic unit of claim 11, wherein the drive circuit further drives the display panel such that, prior to the first sampling, the second and third transistors sample the voltages of the first signal line and the second signal line, while the basic voltage is applied to the first and second signal lines, thereby performing a threshold voltage cancellation operation of causing a voltage between the gate and the source of the driving transistor to approach a threshold voltage of the driving transistor.

13. The electronic unit of claim 11, wherein the plurality of holding capacitors comprise a first capacitor and a second capacitor, where a first electrode of the first capacitor is connected to the gate of the first transistor, a second electrode of the first capacitor is connected to a first electrode of the second capacitor, and a second electrode of the second capacitor is connected to the source of the driving transistor, a source or a drain of the second transistor is connected to the gate of the first transistor, and a source or a drain of the third transistor is connected to the second electrode of the first capacitor.

14. The electronic unit of claim 11, wherein the plurality of holding capacitors comprise a first capacitor and a second capacitor, where a first electrode of the first capacitor is connected to a source or a drain of the second transistor, a second electrode of the first capacitor is connected to the gate of the first transistor and to a first electrode of the second capacitor, and a second electrode of the second capacitor is connected to the source of the first transistor, a source or a drain of the third transistor is connected to the second electrode of the first capacitor.

15. The electronic unit of claim 11, a gate of the second transistor is connected to a first scanning line and a gate of the third transistors is connected to a second scanning line that is different from the first scanning line.

* * * * *